US006572149B2

(12) United States Patent
Long

(10) Patent No.: US 6,572,149 B2
(45) Date of Patent: Jun. 3, 2003

(54) COUPON AND BUSINESS CARD DISTRIBUTION SYSTEM

(76) Inventor: Dennis M. Long, 48 Lubec St., South Portland, ME (US) 04106

( * ) Notice: Subject to any disclaimer, the term of this patent is extended or adjusted under 35 U.S.C. 154(b) by 0 days.

(21) Appl. No.: 09/815,820

(22) Filed: Mar. 23, 2001

(65) Prior Publication Data

US 2002/0008379 A1 Jan. 24, 2002

Related U.S. Application Data

(60) Provisional application No. 60/192,078, filed on Mar. 24, 2000.

(51) Int. Cl.[7] ..... B42D 3/00

(52) U.S. Cl. ..... 283/51; 283/61; 283/56; 283/117

(58) Field of Search ..... 283/51, 116, 34, 283/35, 56, 67, 68, 61, 62; 428/41.1; 281/2, 5; 229/70

(56) References Cited

U.S. PATENT DOCUMENTS

| | | | | | |
|---|---|---|---|---|---|
| 380,616 | A | | 4/1888 | Bobrick | |
| 479,098 | A | * | 7/1892 | Spencer | 283/51 |
| 1,944,853 | A | | 1/1934 | Unger | 229/92.1 |
| 2,108,749 | A | | 2/1938 | Harris | 283/6 |
| 2,159,486 | A | | 5/1939 | Mayer | 229/92.8 |
| 2,300,071 | A | | 10/1942 | Smith | 229/92.1 |
| 3,869,080 | A | | 3/1975 | Anderson | 229/69 |
| 4,093,117 | A | | 6/1978 | Morse | 229/70 |
| 4,097,067 | A | | 6/1978 | Schechter | 283/56 |
| 4,397,417 | A | | 8/1983 | Carlson | 229/92.3 |
| 4,637,633 | A | * | 1/1987 | Instance | 283/81 |
| 4,900,597 | A | * | 2/1990 | Kurtin | 428/41.1 |
| 4,907,826 | A | | 3/1990 | Versage | 283/56 |
| 4,957,311 | A | | 9/1990 | Geisenheimer | 283/56 |
| 5,076,490 | A | | 12/1991 | Dulin | 229/92.8 |
| 5,468,021 | A | | 11/1995 | Ovadia | 283/56 |
| 5,547,225 | A | | 8/1996 | DeAngelis | 281/211 |
| 5,853,837 | A | | 12/1998 | Popat | 428/43 |

* cited by examiner

*Primary Examiner*—Willmon Fridie, Jr.
(74) *Attorney, Agent, or Firm*—Nils Peter Mickelson

(57) ABSTRACT

An improved coupon sales promotion system applies the flexibility of computerized printing to the convenience of coupon sales offers to provide a recipient with coupons of unique relevance and with a cross-referenced map to facilitate use of such coupons.

12 Claims, 4 Drawing Sheets

COUPON AND BUSINESS CARD DISTRIBUTION SYSTEM

CROSS-REFERENCE TO RELATED APPLICATIONS

Provisional Patent Application No. 60/192,078 filed Mar. 24, 2000.

STATEMENT REGARDING FEDERALLY SPONSORED RESEARCH OR DEVELOPMENT

Not applicable

BACKGROUND OF THE INVENTION

This invention relates to the field of coupons and business cards mailed to consumers for promoting sales or the like.

Sales coupons mailed directly to consumers are well known. In most cases, such coupons are printed individually by or on behalf of individual vendors, then gathered and mailed or otherwise distributed in bulk to a broad range of consumers—for example across an entire urban area. Thus, any one recipient may receive coupons from vendors whose place of business is inconveniently far away, or whose products may be of relatively little interest.

It is also common to print coupons in sheet form, many coupons being printed on a single perforated sheet whereby the recipient may tear out coupons of individual interest. Again, however, many of these coupons may be of little use to the recipient.

Examples of earlier coupon systems include U.S. Pat. Nos. 4,097,067 to Schechter (1978) and 5,468,021 to Ovadia (1995).

The recent widespread availability of data processing machines, and the networking thereof both locally as in so-called "local area networks" and broadly as by the so-called "Internet," has made feasible a radical change in the way coupons are deployed.

BRIEF SUMMARY OF THE INVENTION

To provide a system for printing and distributing sales promotion coupons and business cards which more meaningfully addresses the individual needs of potential consumers. The system is based on demographic data and provides individualized coupon sets which explicitly target the needs or desires of individual or sets of consumers grouped according to their locale or preferences. A part of the system further provides ancillary information to benefit the consumer, such as an indexed map of the buying area.

Figure 1:
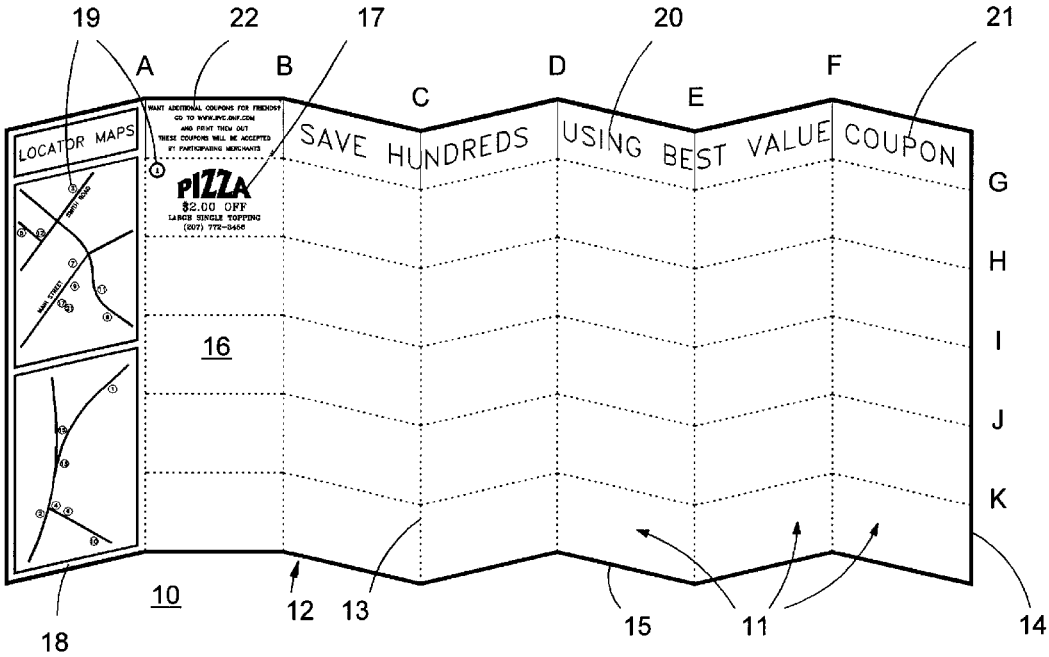
FIG. 1 shows a general view of the invention, creased so that further folding will compress it into its mailing configuration.

| LIST OF REFERENCE NUMERALS |
|---|
| 10 card stock |
| 11 panel |
| 12 front surface |
| 13 perforations |
| 14 right edge |
| 15 bottom edge |
| 16 coupon |
| 17 individualized information |
| 18 mailing panel |
| 19 cross-reference mark |
| 20 folded unperforated strip |
| 21 promotional information |
| 22 instructions |
| 23 back surface |
| 24 common information |
| 25 mailing address |
| 26 compact, flat packet |
| 27 wafer seal |
| 28 label |
| 29 subscribing business |
| 30 recipient |
| 31 data transfer path |
| 32 first data |
| 33 second data |
| 34 third data |
| 35 further information |
| 36 data file "cookie" |
| 37 coupon distributor |
| 38 business relationship |
| 39 individual information |
| 40 recipient mailing address |
| 41 recipient preferences |
| 42 coupon and business card distribution system |

DETAILED DESCRIPTION OF THE INVENTION

A coupon distribution system according to the present invention consists of a single sheet of card stock, either paper- or plastic-based, printed on both its front and back surfaces, perforated to facilitate tearing in a controlled manner and folded to a compact size for mailing.

The front surface is printed in such a pattern that an array of coupons in columns and rows is all visible at once and together. Optionally, one or more rows or columns may be printed as a single panel to provide, for example, advertising or instruction space, or a locator map to help the reader find the companies offering their services. Instructions, as described here, may include directions for obtaining additional coupons, for example by mail, facsimile or data file transfer such as that offered by file-transfer protocol (FTP) or the so-called World Wide Web.

The back surface is printed such that each coupon carries indicia identifying the coupon distributor, and such that at least one panel, folded to be on the outside surface during mailing, may carry information required by the postal service, for example postal permit, addressor and addressee data.

Referring to FIG. 1, what is seen is a single sheet of card stock 10 measuring approximately 11½ inches high by 25 inches wide. This material may be of the traditional paper-fiber type or may be a polymeric plastic film or the like, and the surface seen in FIG. 1 shall be designated the front surface 12 for purposes of illustration. Shown at lines designated by the letters A, B, D and F, the card stock 10 is creased by folding adjacent panels 11 forward toward front surface 12 while each designated line is pressed backward away from front surface 12. At lines designated by C and E, the card stock 10 is creased and folded toward the rear surface in like but opposite fashion, creating thereby folds in alternating directions, sometimes termed "Z-folding." Fold lines A, B, C, D, E and F may include perforations 13 for ease in tearing the stock, such as micro-perforation or other common means.

Perforated lines designated by the letters G, H, I, J and K are flat, or non-creased, perforations for ease in tearing card stock 10 along these lines. In the preferred embodiment shown in FIG. 1, these lines extend from the right edge 14 of the card stock leftwards but only extending to line A. Similarly, in the preferred embodiment, fold lines A, B, C, D, E and F are perforated extending upwards from the bottom edge 15 but only to line G.

Between line A and right edge 14 and between line G and bottom edge 15, the perforations 13 define an array of separable coupons 16, each about 3½ inches wide by 2 inches high, or so-called business card size. In each of these rectangular areas or coupons 16 may be printed specific individualized information 17 provided by an individual subscribing company, such as a sales promotional offer by that company, as well as an offer expiration date and information for identifying and contacting the company.

Information such as the company's street address, telephone number or data path (such as a so-called Internet or World Wide Web address) may be included, as well as automatically readable information such as magnetically encoded data or optically readable data in a format such as the so-called "UPC" or ":CueCat" formats. Such additional information may be used to facilitate communication between the coupon recipient and the subscribing company, as when the recipient requires more information or more coupons. It may also be used by the company to gather information about the recipient, as when each coupon is uniquely encoded.

To the left of line A, in the preferred embodiment, an unperforated and non-folded mailing panel 18 may be printed with instructions or maps of the neighborhood or region encompassing the subscribing companies, and further may be keyed to their individual coupons 16 by cross-reference marks 19 such as numeric references, color codes or the like.

Above line G, a folded but unperforated strip 20 may be imprinted, in the preferred embodiment, with promotional information 21, with instructions 22 on how to use the coupon system, or with any other markings desired. One such instruction 22 may encompass a process for obtaining additional coupons by mail or telephone requests or by data file transfer such as so-called downloading via file transfer protocol (FTP) or by accessing a hypertext markup language (HTML) file using so-called Web browser software programs. An additional advantage of the latter is that an HTML file may contain its own hypertext links to similar files maintained explicitly by the subscribing companies, thereby gaining collateral recognition of, and customer involvement in, said companies themselves. Similarly, an advantage of the latter is that information about the recipient may be automatically gathered by reflexive data exchange such as today's so-called "cookies" or by other means.

Figure 4:
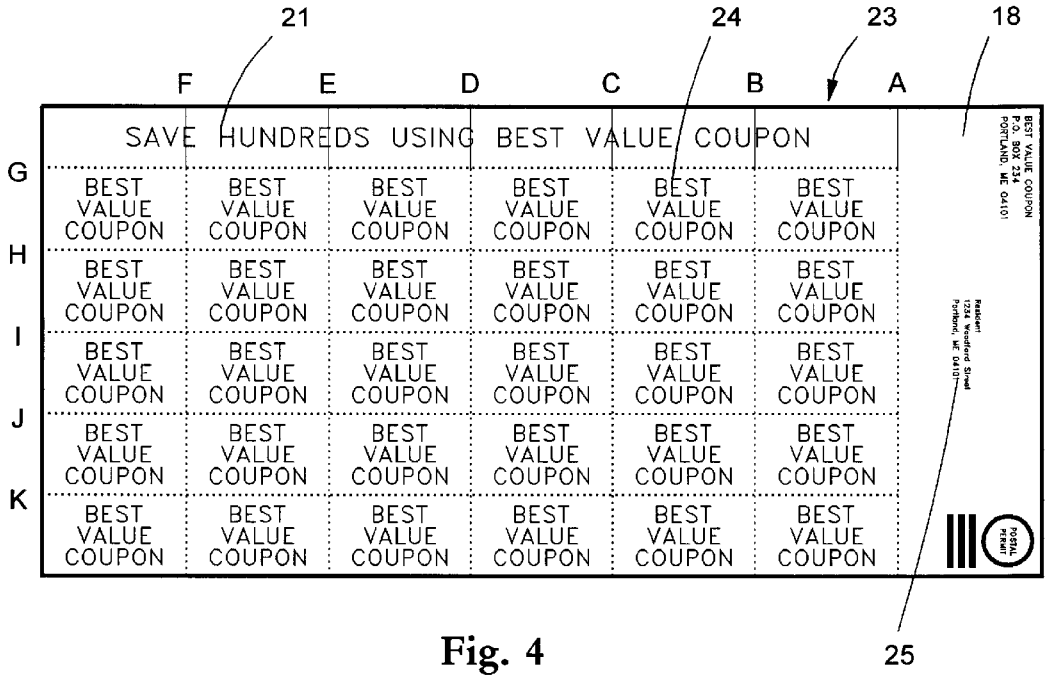
FIG. 4 shows the back surface of the invention in its preferred form.

In FIG. 4 may be seen the back surface 23 of the card stock 10, whereupon the back of each coupon 16 is imprinted with additional individualized information or with common information 24 such as the identification and logo of the coupon distributor. Above line G, on folded but unperforated panel 17, may be printed more instructional or promotional information 21. To the right of line A, on the back surface of unperforated and non-folded panel 18, may be printed such required mailing indicia as postal permits, return address, and the mailing address 25 of the recipient to whom the system is directly mailed.

Figure 2:
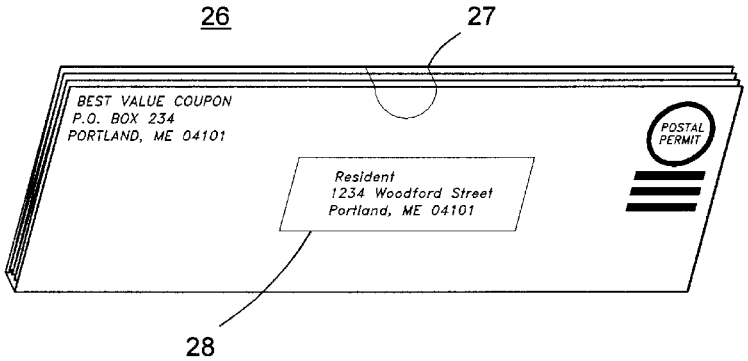
FIG. 2 shows the invention folded, sealed and ready for mailing.
Figure 3:
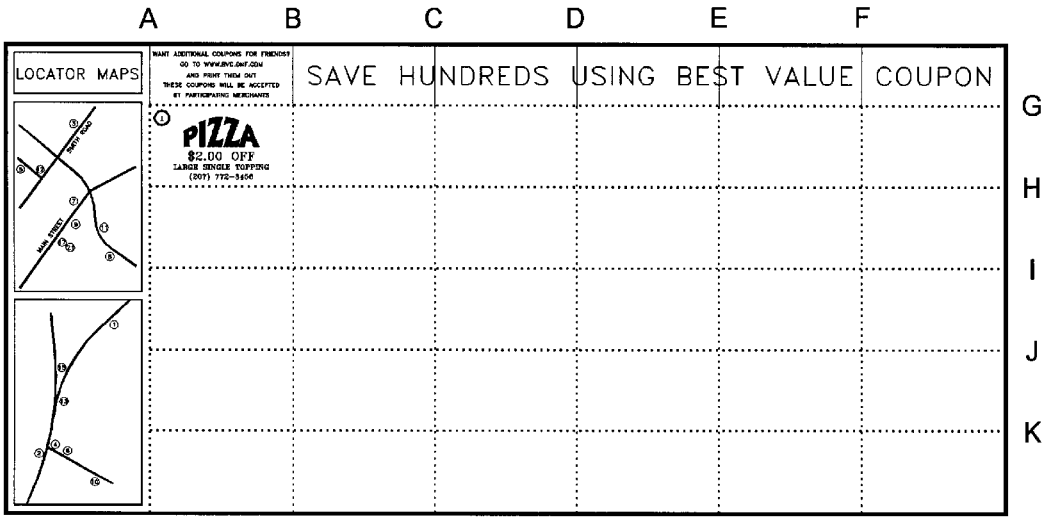
FIG. 3 shows the front surface of the invention in its preferred form.

As shown in FIG. 2, when folded as described, the coupon system forms a compact, flat packet 26, completely ready for mailing when sealed along its open edge by, for example, a transparent clear wafer seal 27. Because the panels are Z-folded, it is not required that the number of panels be restricted to an odd number.

Figure 6:
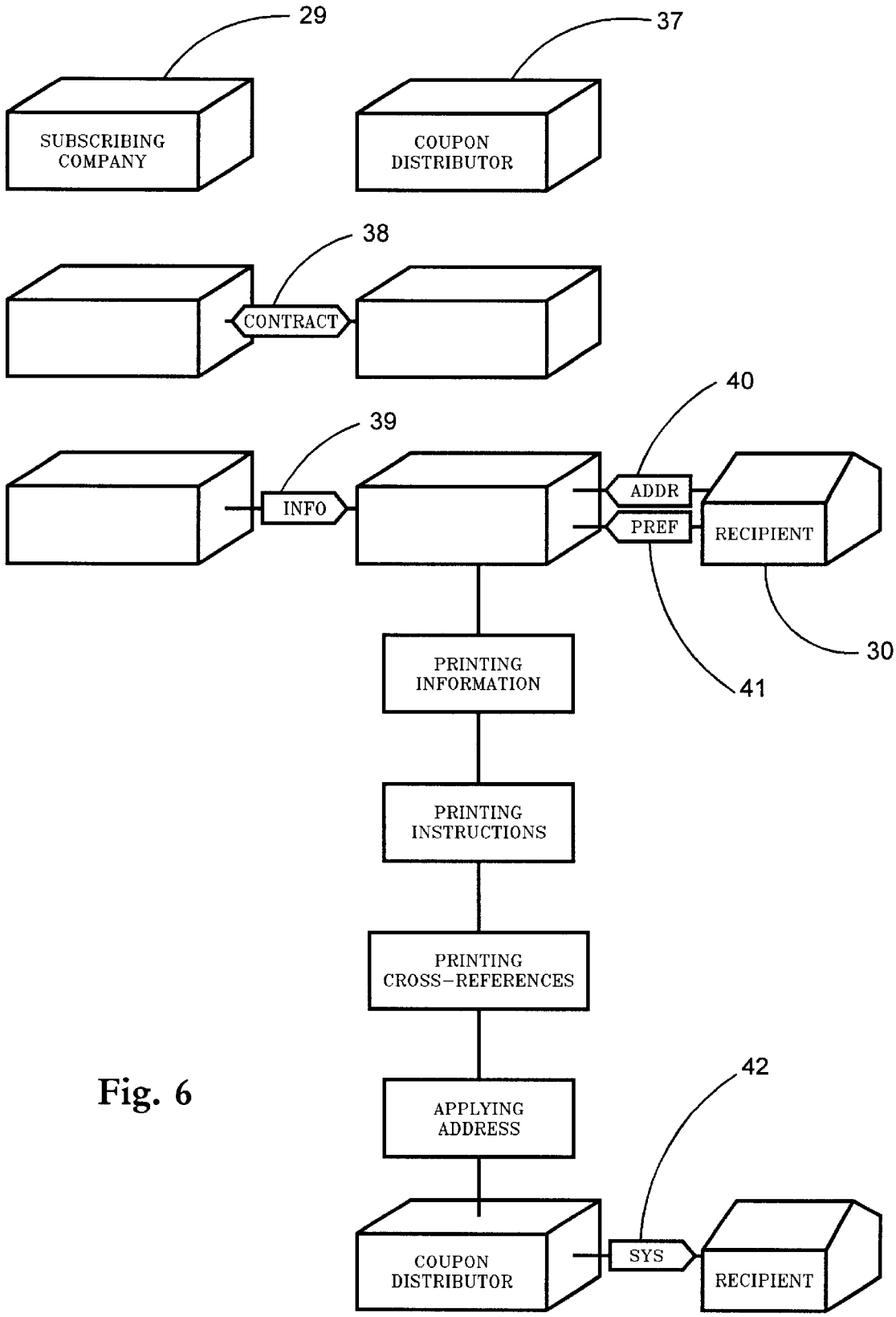
FIG. 6 shows a method for making the invention.

FIG. 6 shows how the system is made by first establishing a business relationship 38 or contract with each of several businesses 29 wherein each agrees to offer a trade incentive to persons presenting coupons 16 at their place of business or in other ways designated by the business. Individual information 39 for each coupon 16 is established and is printed on sheet stock 10 using any of a number of traditional techniques. Because each sheet stock 10 is mailed directly to an individual address 40 or recipient 30, there can be some benefit obtained by customizing each individual sheet stock 10 with coupons 16 of preference 41 uniquely to that recipient, for example for companies doing business in the recipient's geographical region or for products or services of greater personal interest or relevance to the recipient. Using demographic data about the recipient in conjunction with data processing systems and common computer printers facilitates the printing of a customized coupon sales promotion system or card stock 10 for each individual recipient or grouping of recipients. Trimming, creasing and perforating operations may be done before or after printing, as desired. The addressee may be indicated by such means as a label 28 or by direct printing on the card stock 10.

Upon receipt, the recipient tears the wafer seal 27 and with a single pull is presented with a convenient array of coupons 16, all visible simultaneously. The location of individual particular coupons 16 within the array may be adjusted during printing to improve the recipient's attention to selected coupons 16. Should the recipient choose to use one or more of the coupons 16, he or she would tear along the perforations to remove those coupons 16 from the array and would bring or otherwise present the appropriate coupon 16 to the business of choice, aided by the cross-referenced map or instructions if provided. Where the coupons 16 are business card size, they may act as business cards as well as promotional coupons.

Figure 5:
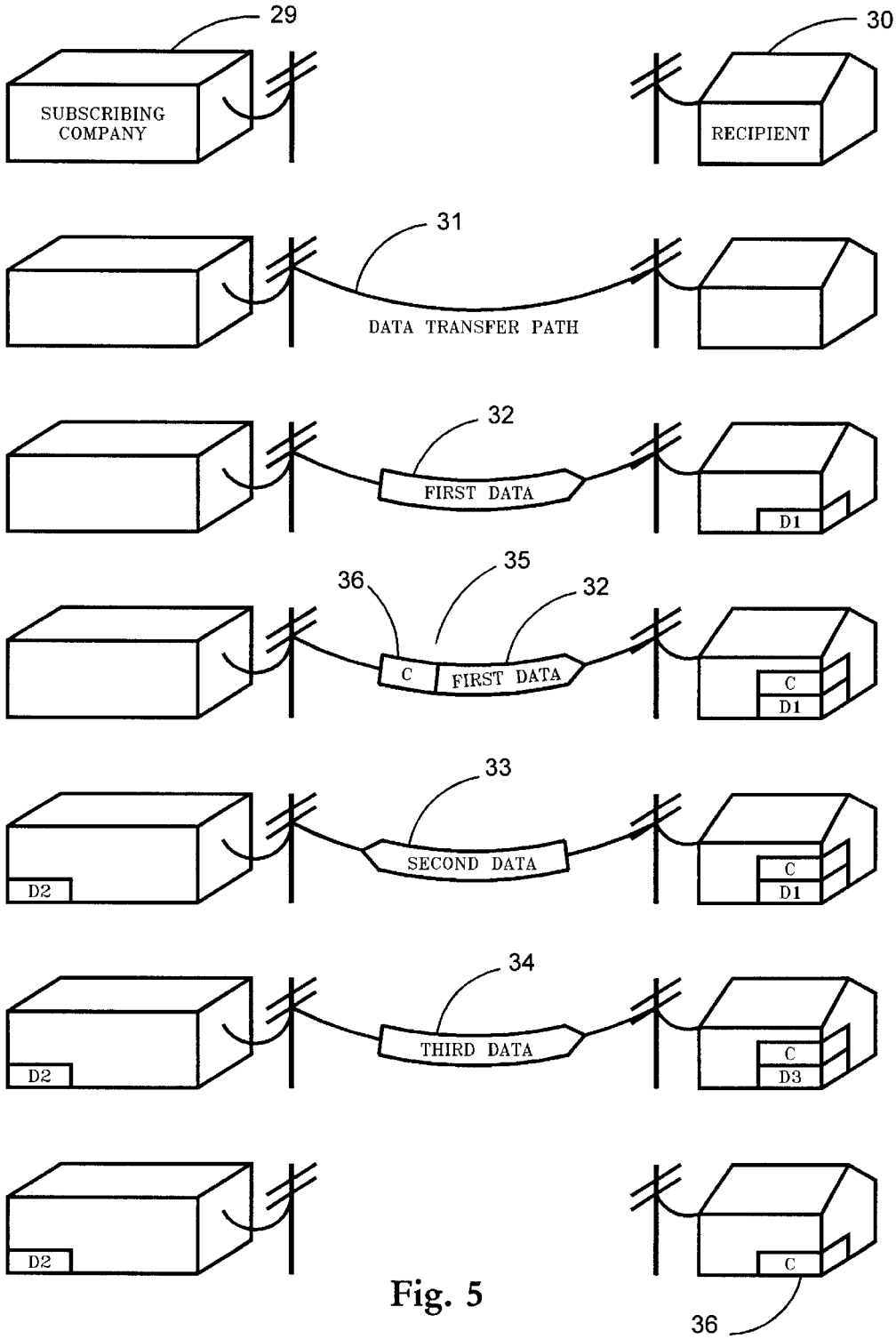
FIG. 5 shows a method for using the invention.

Though prosaic, FIG. 5, a description of how data transfer as envisaged herein might take place, is included here for reference. It is common to store data in some format such as cuneiform tablets or magnetic disk domains. Such data may be transferred along a data path by direct carriage or by transmission through a medium such as electromagnetic waves. In each case, the format of the stored data, known today as a "file," must be in a form readable by the sender and by the recipient. A popular data format today is HTML code, which comprises simple text characters which when properly processed appear as a document containing both text and so-called "links" to other data files. A popular means of transporting HTML or other data is to establish a transfer path 31 for such data, such as a telephone line, along which path a recipient 30 may request a data file from a holder such as a subscribing business 29. In reply, the data holder would transmit this first data file to the recipient. Commonly such a data file might include company identification and instructions for accessing further data by means, for example, of a so-called "hypertext" link. Should the recipient desire further information 35, he or she may be required by the company to provide second data 33 such as personal identification or demographic data. In return for such information, the subscribing company might transmit further third data 34 in a format which allows printing of additional coupons, for example, on the premises of the recipient. Additionally, the recipient may allow the company to transmit a separate data file 36, today termed a "cookie," which is stored by the recipient for automatic retrieval by the company upon demand. Such files may contain data encoded to reveal the time or date or means by which the original transaction took place, which data may be of demographic use to the subscribing business 29.

While the preferred embodiment is here fully described, it should be clear that many variations of the invention lie well within the scope of the claims which follow.

I claim:

1. A coupon and business card distribution system comprising a plurality of individual panels, approximately equal in size and shape, attached edge to edge seriatim along perforated fold lines, each said panel having a front and a back surface;

(a) at least one of said panels divided by perforated lines into separable coupons, each said coupon bearing on said front surface individualized information from a subscribing business regarding a sales offer or the like, said individualized information including a cross-reference mark;

(b) at least one of said panels being a mailing panel, not so divided, said mailing panel bearing on said back surface mailing indicia including the mailing address of a recipient, and on said front surface instructions including markings correlated to each said cross-reference mark;

whereby all said divided panels are Z-folded together, said mailing panel is folded over said Z-folded panels and sealed thereto to create a compact packet for mailing.

2. The coupon and business card distribution system of claim 1 wherein said fold lines are unperforated along only a portion of their length, said unperforated portion of their length creating thereby a folded unperforated strip.

3. The coupon and business card distribution system of claim 2 wherein said folded unperforated strip is printed with information selected from the group consisting of instructions, promotional information and a process for obtaining additional coupons.

4. A method for using the coupon and business card distribution system of claim 3 wherein said process for obtaining additional coupons comprises the steps of:

(a) establishing a data transfer path for transfering data between said recipient and said subscribing business;

(b) transfering first data from said subscribing business to said recipient, said first data comprising information selected from the group consisting of company identification, instructions for accessing third data and further information provided by said subscribing business;

(c) transfering second data from said recipient to said subscribing business, said second data comprising information selected from the group consisting of identification of said recipient and a request for said third data; and (d) transfering said third data from said subscribing business to said recipient, said third data comprising information encoded to permit printing of additional coupons by said recipient.

5. The method for using the coupon and business card distribution system of claim 4 wherein said further information provided by said subscribing business further comprises a data file, commonly known as a "cookie," stored by said recipient for future data transfer transactions.

6. The coupon and business card distribution system of claim 1 wherein the back surface of each said coupon is printed with common information.

7. The coupon and business card distribution system of claim 1 wherein said instructions comprise a map.

8. The coupon and business card distribution system of claim 1 wherein said cross-reference marks are selected from the group consisting of numbers, letters, unique symbols and colors.

9. The coupon and business card distribution system of claim 1 wherein said mailing address of a recipient is applied as a label.

10. The coupon and business card distribution system of claim 1 wherein said card stock comprises paper-fiber type material.

11. The coupon and business card distribution system of claim 1 wherein said card stock comprises polymeric plastic material.

12. A method for making the coupon and business card distribution system of claim 1 comprising the steps of:

(a) said subscribing business establishing a business relationship with a coupon distributor;

(b) said subscribing business providing individualized information to said coupon distributor;

(c) said coupon distributor identifying intended recipients, their mailing addresses and their preferences;

(d) said coupon distributor arranging and printing said individualized information on said coupons located at positions selected to optimally serve said recipient and said subscribing business;

(e) said coupon distributor printing instructions on said mailing panel front surface, said instructions selected from the group consisting of a map, instructions for using said coupon and business card distribution system, instructions for obtaining additional coupons and an index;

(f) said coupon distributor printing, on each said coupon and on said instructions, each said cross-reference mark;

(g) said coupon distributor applying on said mailing panel back surface said mailing indicia, including the mailing address of said recipient; and (h) mailing each said coupon and business card distribution system to each said recipient.

* * * * *